United States Patent [19]

Heitmann et al.

[11] Patent Number: 4,889,138

[45] Date of Patent: Dec. 26, 1989

[54] METHOD OF AND APPARATUS FOR SIMULTANEOUSLY MAKING PLURAL TOBACCO STREAMS

[75] Inventors: Uwe Heitmann; Peter Brand, both of Hamburg, Fed. Rep. of Germany

[73] Assignee: Körber AG, Hamburg, Fed. Rep. of Germany

[21] Appl. No.: 57,783

[22] Filed: Jun. 3, 1987

[30] Foreign Application Priority Data

Jun. 11, 1986 [DE] Fed. Rep. of Germany ..... 3619579

[51] Int. Cl.[4] ..... A24C 5/18; A24C 5/28

[52] U.S. Cl. ..... 131/84.1; 131/84.3; 131/84.4; 131/110

[58] Field of Search ..... 131/84.1, 84.2, 84.3, 131/84.4, 110

[56] References Cited

U.S. PATENT DOCUMENTS

| | | | |
|---|---|---|---|
| 3,088,468 | 5/1963 | Labbe | 131/84.3 |
| 4,175,570 | 11/1979 | Heitmann | 131/84.3 |
| 4,372,326 | 2/1983 | Serganoli | 131/84.1 |
| 4,377,098 | 3/1983 | Bardehagen et al. | 813/310 |
| 4,463,768 | 8/1984 | Quarella | 131/84.2 |
| 4,564,026 | 1/1986 | Wahle et al. | 131/84.3 |
| 4,651,754 | 3/1987 | Lorenzen et al. | 131/84.1 |

*Primary Examiner*—Vincent Millin

*Attorney, Agent, or Firm*—Peter K. Kontler

[57] ABSTRACT

A first stream of tobacco particles is subdivided into several narrower streams at a diverting station where the lowermost portions of several upwardly sloping panels are inclined with reference to each other and with reference to a foremost panel which guides the first stream. First nozzles which discharge compressed air are used to compel the particles of the first stream to advance along the concave upper side of the foremost panel, and additional nozzles are used to discharge compressed air which compels the second streams to advance along the concave upper sides of the respective panels. The distribution of particles across the first stream and/or at the diverting station can be regulated by one or more partitions at the diverting station, by nozzles which blow particles across the first stream, by a pivotable flap in the distributor which supplies particles to the building zone for the first stream, or by a pivotable flap in a vibratory conveyor which returns to the distributor surplus particles removed from the second streams during their conversion into rod-like fillers of discrete tobacco rods.

6 Claims, 4 Drawing Sheets

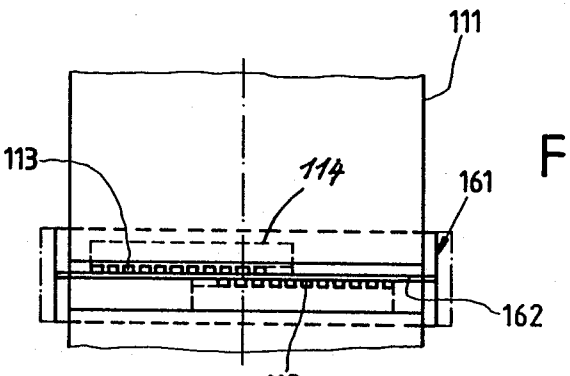
Fig.5
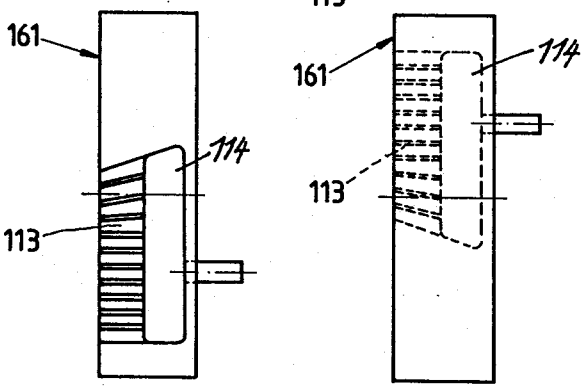
Fig.8
Fig.7
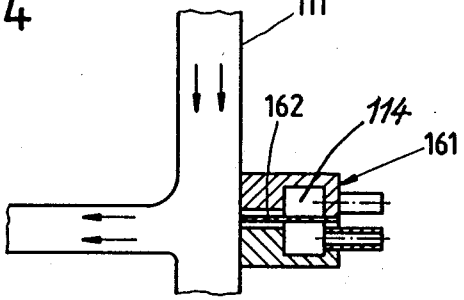
Fig.4
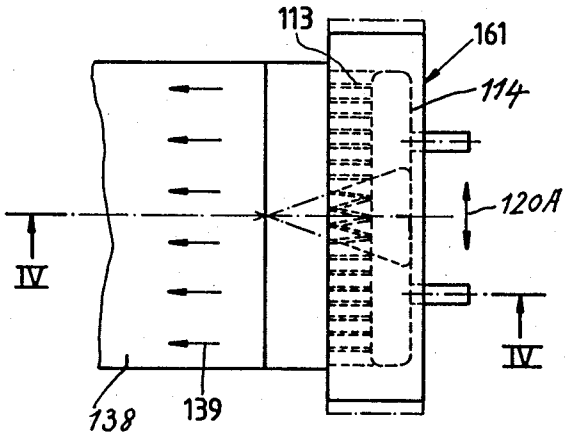
Fig.6

METHOD OF AND APPARATUS FOR SIMULTANEOUSLY MAKING PLURAL TOBACCO STREAMS

CROSS-REFERENCE TO RELATED CASE

Certain details of the apparatus of the present invention are similar to those of apparatus which are disclosed in our commonly owned copending patent application Ser. No. 891,540 filed July 31, 1986 for "Method And Apparatus For Building A Continuous Stream Of Tobacco Or The Like".

BACKGROUND OF THE INVENTION

The invention relates to improvements in methods and apparatus for simultaneously making several streams of fibrous material, such as tobacco. More particularly, the invention relates to improvements in methods and apparatus for simultaneously making at least two substantially identical streams of fibrous material which can be converted into rod-like fillers ready for draping into webs of cigarette paper or the like to form rods which are subdivided into plain cigarettes, cigars, cigarillos or other rod-like smokers' products.

It is known to simultaneously form several cigarette rods and to subdivide such rods into cigarettes of unit length or multiple unit length. The method and apparatus of the present invention are designed to furnish streams of fibrous material, such as natural, reconstituted and/or artificial tobacco, which can be converted into discrete rod-like fillers in a machine which is constructed to simultaneously turn out two or more identical or practically identical rods wherein wrappers of cigarette paper or other suitable wrapping material surround rod-like fillers of fibrous material including filter material for tobacco smoke and/or tobacco. As a rule, a single stream of fibrous material is subdivided into two streams which are then transferred onto air-permeable belt conveyors for conversion into rod-like fillers and for draping of fillers into webs of wrapping material. A drawback of presently known methods and apparatus is that the making of two or more identical or substantially identical streams is a costly procedure which necessitates the use of complex, bulky and expensive apparatus and that the quality of all products is not uniform.

OBJECTS AND SUMMARY OF THE INVENTION

An object of the invention is to provide a simple but efficient method of converting a single stream of fibrous material into several smaller streams which are ready to be processed in a cigarette rod making or other machine to form rod-like fillers of cigarette rods or the like.

Another object of the invention is to provide a method which renders it possible to accurately regulate the quantity of fibrous material in each stream and to rapidly and reliably adjust the ratio of fibrous material in the streams which are obtained as a result of subdivision of a larger stream.

A further object of the invention is to provide a method which can be practiced to make two or more rod-like fillers for conversion into rods which are thereupon subdivided into plain cigarettes or other rod-like smokers' products.

An additional object of the invention is to provide a novel and improved apparatus for the practice of the above outlined method and to provide the apparatus with novel and improved means for converting a single stream of fibrous material into two or more smaller streams in a small area and with a high degree of predictability and reproducibility.

Still another object of the invention is to provide the apparatus with novel and improved means for regulating the quantity of fibrous material in each of several smaller streams which are obtained as a result of subdivision of a larger stream.

A further object of the invention is to provide a tobacco processing machine (such as a cigarette maker) which embodies the above outlined apparatus.

Another object of the invention is to provide the apparatus with novel and improved means for classifying the fibrous material according to size and/or quality prior to conversion into several streams which are ready to yield rod-like fillers in a cigarette maker or a like machine.

One feature of the present invention resides in the provision of a method of simultaneously making a plurality of streams of fibrous material, such as tobacco. The method comprises the steps of building or growing a first stream of fibrous material and conveying the first stream in a predetermined direction along an arcuate first path, and dividing the first stream into a plurality of second streams including diverting fibrous material of the first stream from the first path into a plurality of divergent second paths. The second paths are or can be arcuate paths, and the method further comprises the step of conveying the second streams along the respective second paths in, or generally in, the predetermined direction. The first stream can include a first moving carpet of fibrous material which travels along the first path and has a first width, and each second stream can include a second carpet which travels along the respective second path and has a lesser second width. The sum of second widths equals or approximates the first width.

The conveying step can include conveying the first stream along an arcuate first guide surface, and the method can further comprise the step of conveying the second streams along second guide surfaces, preferably along arcuate guide surfaces. Each guide surface can constitute or include a concave guide surface.

Each of the second paths can extend from a lower first level where it diverges from the first path to a higher second level.

Each conveying step can include subjecting the fibrous material of the respective streams to the action of an accelerating medium, such as compressed air or another compressed gaseous fluid. The building step can include subjecting the fibrous material to the action of at least one first current of compressed air, and the diverting step can include subjecting the fibrous material to the action of at least one second current of compressed air.

The method can further comprise the step of regulating the quantities of fibrous material in the second paths. Such regulating step can include regulating the quantities of fibrous material which enter the second paths, i.e., in or close to the region where the second paths diverge from the first path. Such regulating step can include varying the widths of the second paths. Alternatively, the regulating step can include varying the quantity of fibrous material in the first path transversely of the predetermined direction. This can involve shifting fibrous material in the first path with currents of compressed air or another gaseous fluid. The building step can include uniting several discrete flows of fibrous material into the first stream, and the regulating step can include varying the distribution of fibrous material in one of the flows across the first path. Such method can further comprise converting each second stream into a substantially rod-like filler, and the converting step normally or invariably includes removing fibrous material from the respective second streams. The removed fibrous material is then accumulated into the aforementioned one flow.

Another feature of the invention resides in the provision of an apparatus for simultaneously making a plurality of streams of fibrous material, such as tobacco. The apparatus comprises first conveyor means having a first guide surface (particularly a concave guide surface) defining a first path, and means for building a continuous first stream of fibrous material (e.g., in a first portion of the first path). The first conveyor means further comprises means for advancing the first stream in a predetermined direction along the first path, and the apparatus further comprises a plurality of second conveyor means each having a second guide surface (particularly a concave surface) defining a discrete second path. Each second path diverges from the first path downstream of the stream building means, i.e., downstream of the aforementioned first portion of the first path, and the second conveyors further comprise means for diverting different portions of the first stream into the respective second paths wherein the diverted portions of the first stream form second streams advancing along the respective second paths. The inlet ends of the second paths communicate with the first path, and the outlet ends of the second paths are preferably located at levels above the respective inlet ends. The second conveyor means further comprise means for advancing the second streams along the respective second paths, and all of the advancing means can include means for accelerating the fibrous material in the respective paths. The means for accelerating the fibrous material of the first stream can be similar to the means for accelerating the fibrous material of the second streams. Each of the accelerating means can comprise at least one nozzle having means for directing a current of compressed gaseous fluid (normally air) against the fibrous material of the respective stream. The directing means (e.g., orifices) of the nozzles can be oriented to direct compressed gaseous fluid against or in substantial parallelism with the respective guide surfaces.

The diverting means can include a partition which is movable transversely of the predetermined direction to increase the width of one second stream while simultaneously narrowing another second stream.

The diverting means can also comprise (or the diverting means can further comprise) a source of compressed gaseous fluid and nozzles for directing currents of gaseous fluid from the source against selected portions of the first stream. Such nozzles are preferably adjustable to alter or shift the direction of the respective current of gaseous fluid.

The diverting means can form part of the stream building means.

The apparatus can further comprise means for regulating the distribution of fibrous material of the first stream among the second streams. Such regulating means can constitute the aforementioned part of the stream building means or the aforementioned nozzles which direct currents of gaseous fluid from the source of compressed gaseous fluid against selected portions of the first stream. For example, the stream building means can include at least two feeding units each of which is arranged to supply fibrous material to a predetermined portion of the first path, and the regulating means can include means for varying the distribution of fibrous material from one of the feeding units across the predetermined portion of the first path. Such one feeding unit can deliver fibrous material which is removed from the second streams during conversion of second streams into rod-like fillers which are ready to be draped into webs of cigarette paper or the like to form tobacco-containing rods.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is an enlarged fragmentary partly elevational and partly vertical sectional view of a second apparatus wherein the distribution of fibrous material which forms the first stream is regulated upstream of the diverting station, the section being taken in the direction of arrows as seen from the line IV—IV of FIG. 6;

FIG. 5 is a view as seen from the left-hand side of FIG. 4;

FIG. 6 is a plan view of the structure which is shown in FIG. 4;

FIG. 7 is a plan view of a detail in the structure of FIGS. 4–6;

FIG. 8 is a similar view of another detail in the structure of FIGS. 4–6;

DESCRIPTION OF THE PREFERRED EMBODIMENTS

Figure 1:
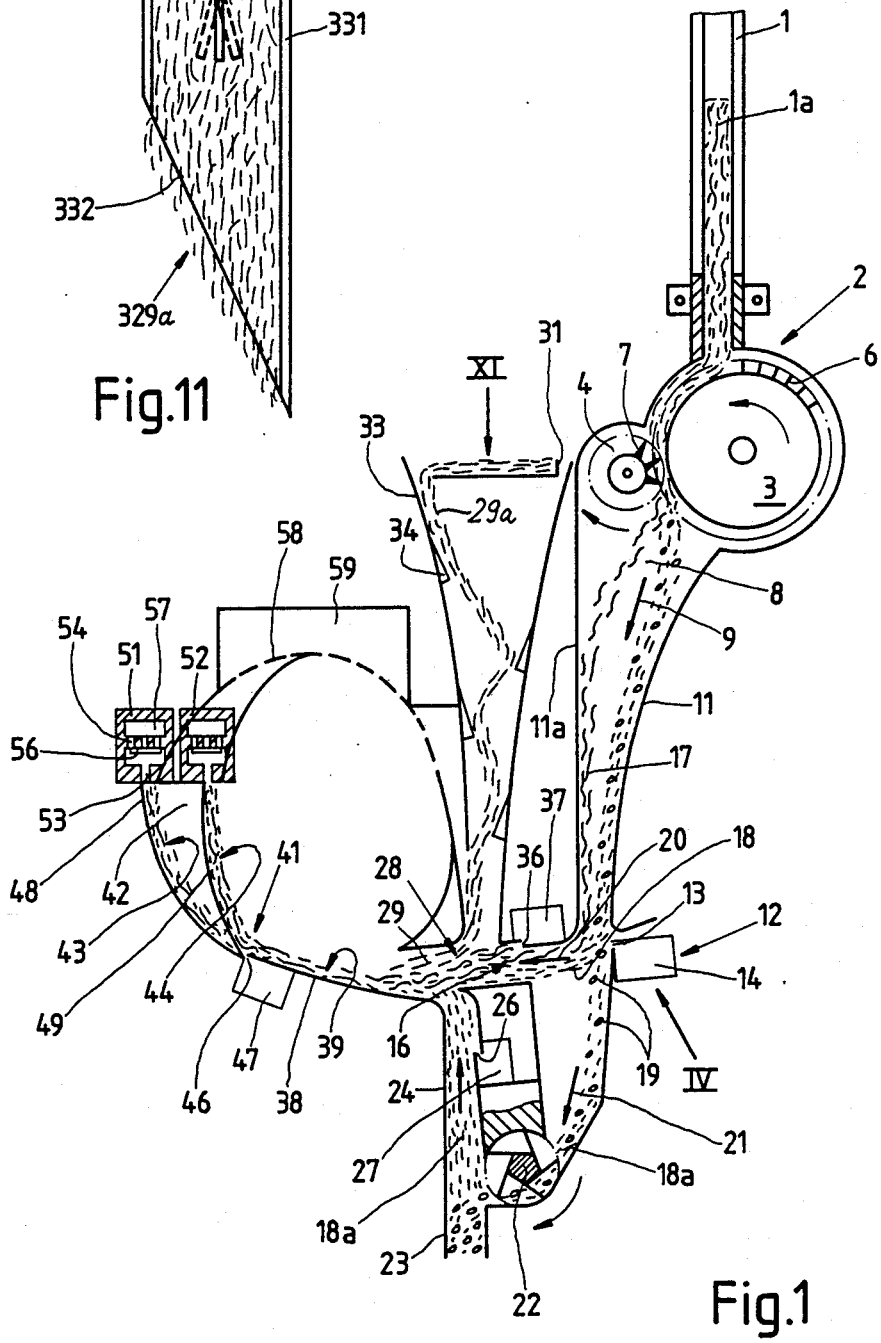
FIG. 1 is a schematic vertical sectional view of an apparatus which embodies one form of the invention and is designed for use in a machine for making two identical tobacco-containing rods.
Figure 3:
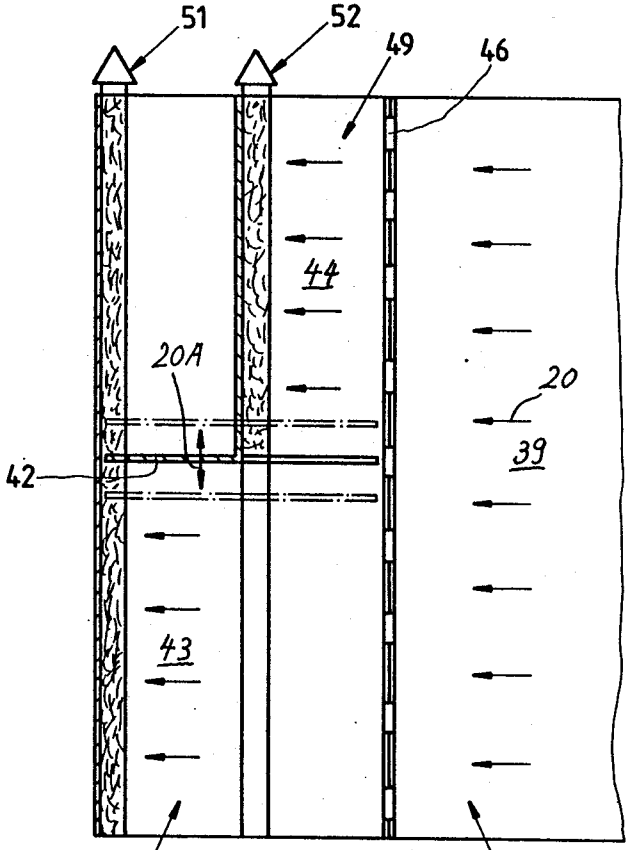
FIG. 3 is a view as seen in the direction of arrow III in FIG. 2, with the partition between the paths for the second streams shown in a horizontal sectional view.
Figure 2:
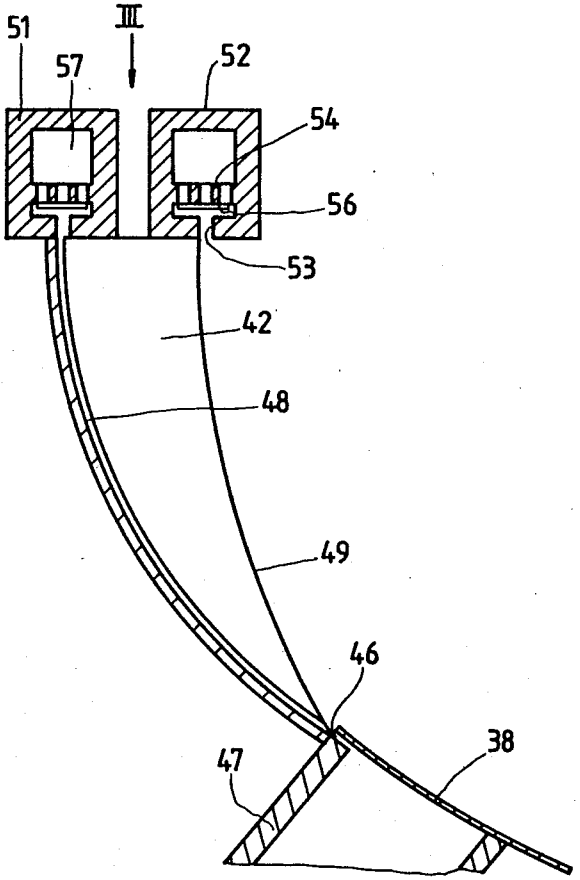
FIG. 2 is an enlarged vertical sectional view of a detail at a material diverting station of the apparatus which is shown in FIG. 1.

FIGS. 1 to 3 show a portion of an apparatus which embodies one form of the invention. The apparatus comprises a distributor (also called hopper) with two feeding units which supply fibrous material (particularly fragments of tobacco leaves) to form a first stream 39, and such stream is thereupon subdivided into several smaller second streams including the streams 43 and 44 which are shown in the left-hand portion of FIG. 1 and in FIG. 3.

The first feeding unit comprises an upright duct 1 which receives batches of fibrous material to form a column 1*a*. The column 1*a* can contain long and short shreds of tobacco leaf laminae as well as fragments of tobacco ribs. Means (not shown) is provided to maintain the upper level of the column 1*a* in the duct 1 at or close to an optimum level. Reference may be had, for example, to FIG. 4 of the aforementioned commonly owned copending patent application Ser. No. 891,540 as well as to numerous United States Letters Patent of the assignee of the present application.

The lower end portion of the duct 1 is located above an evacuating zone 2 wherein a drum 3 is driven in a counterclockwise direction and has a peripheral surface carrying a carding 6 which draws a continuous layer of fibrous material (hereinafter called particles of tobacco) into the range of pins 7 on a rapidly rotating picker roller 4 which expels the particles of tobacco from the carding 6 and forms a shower 8 which descends into the upper end portion of a funnel-shaped channel 11. The direction in which the particles of tobacco descend in the channel 11 is indicated by an arrow 9. The RPM of the picker roller 4 is much higher than (e.g., several times) the RPM of the carded drum 3. The narrower lower portion of the channel 11 is adjacent an accelerating device 12 including a source 14 of compressed air and one or more nozzles 13 which direct currents of compressed air across the particles of tobacco which descend in the channel. Such particles include relatively long and lightweight shreds 17 which constitute the most desirable part of the shower 8 and tend to advance along the left-hand wall 11*a* of the channel 11, and a mixture of heavier particles 19 (including or consisting of comminuted ribs, birds' eyes and like parts of tobacco leaves) with lightest particles 18 (such as comminuted shreds 17). The heavier particles 19 advance along the right-hand wall of the channel 11 due to inertia, i.e., the trajectories of heavier particles 19 which leave the region where the pins 7 of the picker roller 4 expel fragments of tobacco leaves from the carding 6 of the drum 3 are more predictable and longer than those of the lighter shreds 17. The lightest particles 18 are entrained by the heavier particles 19.

The current or currents of compressed air which issue from the nozzle or nozzles 13 of the accelerating device 12 form a curtain of classifying air which can be traversed by the heavier particles 19 and by some very light particles 18*a*. However, at least the bulk of lighter particles 17 is deflected in the direction of arrow 20 to enter a uniting or stream forming or building zone 28. The reference character 16 denotes a mixture of lightweight shreds 18 and 19 which are caused to advance in the direction of arrow 20 and such particles enter a stream building zone 28 where they are acted upon by one or more currents of compressed air issuing from the orifices of accelerating nozzles 36 receiving compressed air from a source 37. The sources 14 and 37 can form a single source, or each thereof can constitute or comprise a discrete plenum chamber.

The heavier particles 19 which have traversed the curtain of compressed air issuing from the nozzle or nozzles 13 descend in the direction of arrow 21 and entrain the lightweight particles 18*a* to pass through a cell wheel 22 and to enter a second channel or duct 23 serving to admit heavier particles 19 into a collecting receptacle (not shown) or the like. The lighter particles 18*a* rise in a duct 24 which extends upwardly from the duct 23 under the venturi or injector action of one or more nozzles 26 receiving compressed air from a source 27 and directing one or more currents of air toward the stream building zone 28. The rising particles 18*a* are admixed to the flow 29 of fibrous material which accumulates in the zone 28 and includes the particles 19, the particles 18 which were defected by the current or currents issuing from the accelerating nozzle or nozzles 13 and 36, and the particles 18*a* which were segregated from the particles 19 under the action of one or more currents of compressed air issuing from the nozzle or nozzles 26.

Some segregation of lighter particles 17 from heavier particles 19 in the channel 11 is desirable and advantageous because this ensures that the bulk of particles 17 cannot be interlaced with heavier particles 19 to such an extent that the lighter particles 17 would tend to traverse the curtain of compressed air which is formed by the nozzle or nozzles 13 and would descend toward and into the cell wheel 22.

The second feeding unit comprises a conveyor 31 which includes or constitutes a vibratory trough and discharges a flow 29*a* of surplus tobacco particles from several trimming or equalizing devices of the cigarette rod making machine which embodies the apparatus of FIG. 1. The flow 29*a* which is discharged by the conveyor 31 descends in an upright duct or channel 33 having suitably distributed and oriented deflectors 34 which cause the descending flow to form a meandering body entering the stream building zone 28 and being superimposed upon to the flow 29 to form therewith the first stream 39.

Figure 11:
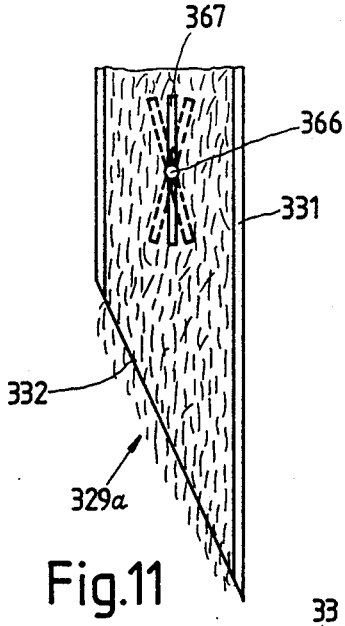
FIG. 11 is a plan view of a conveyor which returns surplus fibrous material into the stream building zone an further showing a fourth device which can be used to regulate the distribution of fibrous material across the first stream, the view being taken substantially as seen in the direction of arrow XI in FIG. 1.

The discharge end of the conveyor 31 is preferably formed with an oblique edge face similar to the edge face 332 of the conveyor 331 of FIG. 11, and such oblique edge face spreads the returned surplus of tobacco across the duct 33 to form the flow 29*a*.

The source 37 of compressed air and the nozzle or nozzles 36 form part of a first conveyor means which further includes a sheet metal or elastic panel 38 having a concave guide surface along which the first stream 39 is advanced in the direction of arrow 20. The path which is defined by the conveyor means including the source 37, the nozzle or nozzles 36 and the panel 38 is relatively wide (see FIG. 3), and the particles of this stream are advanced toward and into a diverting or dividing zone or station 41 wherein the stream 39 is divided into the narrower streams 43 and 44. Such narrower streams are advanced in the general direction of arrow 20 by two second conveyor means which include discrete panels 48, 49 having concave guide surfaces for the respective second streams 43, 44. The two second conveyor means further include a common source 47 of compressed air and a row of nozzles 46 which direct currents of compressed air against or in substantial parallelism with the concave surfaces of the panels 48, 49 to accelerate and advance the second streams 43, 44 from a lower level (where the inlets of the paths defined by the panels 48, 49 communicate with the path for the first stream 39 at the diverting station 41) to a higher level where the outlet ends of the second paths admit the particles of the respective second streams 43, 44 into two parallel elongated channels 53 extending at right angles to the plane of FIG. 1 and serving to deliver particles against the undersides of the lower reaches of two foraminous belt conveyors 56. Each lower reach travels below the perforated bottom wall 54 of a discrete suction chamber 57 forming part of a composite conveyor stream 51, 52 serving to advance the second streams at the undersides of the lower reaches of the conveyors 56 to trimming or equalizing stations where the streams are converted into rod-like fillers as a result of removal of surplus fibrous material, and the fillers are then draped into webs of cigarette paper or other suitable wrapping material to form two discrete tobacco rods which are ready to be subdivided into cigarettes, cigars or cigarillos of unit length or multiple unit length. The removed surplus is accumulated and delivered to the vibratory trough conveyor 31 to form the flow 29*a* which is then united with the flow 29 in the stream building zone 28 to form the first stream 39. The manner in which the surplus can be removed from the second streams at the undersides of the lower reaches of the foraminous belt conveyors 56 is or can be the same as shown in FIG. 3 of the aforementioned copending patent application Ser. No. 891,540 and in numerous United States Letters Patent of the assignee of the present application.

The surplus of compressed air which is supplied by the nozzles 13, 36, 26 and 46 passes through a sieve or screen 58 and its pressure is allowed to drop in an expansion chamber 59.

It will be noted that the means (nozzles 13, 26 and 36) for accelerating the particles of the first stream 39 is similar to the means (nozzles 46) for accelerating the second streams 43 and 44.

The orientation of the nozzles 36 and 46 (and more specifically of the orifices of these nozzles) is preferably such that the first stream 39 is urged against the concave guide surface of the panel 38 and that the streams 43 and 44 are urged against the concave guide surfaces of the respective panels 48, 49. This ensures a predictable division of the first stream 39 into the second streams 43, 44 and entry of the streams 43, 44 into the respective channels 53 beneath the lower reaches of the respective foraminous belt conveyors 56.

The means for dividing the first stream 39 into the second streams 43, 44 comprises a partition 42 which is best shown in FIGS. 2 and 3 and is movable transversely of the direction which is indicated by arrow 20 (note the double-headed arrow 20A in FIG. 3) so as to widen the path for the second stream 43 while simultaneously narrowing the path for the second stream 44 or vice versa. The partition 42 can be shifted by hand or in automatic response to signals from monitoring means serving to ascertain the density of the streams 43 and 44. The arrangement is preferably such that the mass per unit length of the stream 43 equals or closely approximates the mass per unit length of the stream 44.

The concave guide surface of the panel 48 diverges gradually from the concave guide surface of the panel 49 starting at the diverting station 41 and continuing toward or even all the way to the lower ends of the respective channels 53.

FIG. 3 shows that the tobacco stream 39 on the concave surface of the panel 38 forms a relatively wide carpet which advances in the direction of arrow 20 toward the diverting station 41 and that each of the second streams 43, 44 forms a second carpet which is narrower than the carpet constituting the stream 39. The combined width of the carpets or streams 43, 44 equals the width of the stream or carpet 39. Thus, the width of one of the narrower carpets can be increased or reduced at the expense of the other narrower carpet by shifting the partition 42 in one of the directions which are indicated by the arrow 20A. The panels 48, 49 can constitute integral or separable parts of the partition 42. Adjustments of the partition 42 in one or the other of the directions indicated by arrow 20A will be necessary if the distribution of tobacco particles on the panel 38 is not uniform, i.e., if one or more longitudinally extending zones of the first stream 39 contain more or less tobacco than the others. It will be seen that the width of both second paths (defined by the second conveyor means including the panels 48 and 49) need not be identical, as long as the quantity of tobacco particles in the stream 43 equals or closely approximates the quantity of tobacco particles in the stream 44. This ensures that the weight of fillers in cigarettes which are made from the rod including the stream 43 will be identical or practically identical with the weight of the fillers of cigarettes containing the particles of the stream 44.

The apparatus of FIG. 1 can use two or more partitions 42 to divide the first stream 39 into three or more second streams. Such second streams can be processed in a machine using tobacco rod making and severing means of the type disclosed, for example, in commonly owned U.S. Pat. No. 4,377,098.

FIGS. 4 to 8 show a portion of a second apparatus wherein the means for dividing the first stream 139 into two second streams includes two rows of nozzles 113 receiving compressed air from a suitable source 114. One row of nozzles 113 has orifices oriented to direct tobacco particles onto the left-hand or right-hand portion of the concave guide surface of the panel 138, and the other row of nozzles 113 has orifices oriented to direct the particles of tobacco onto the right-hand or left-hand portion of the guide surface of 138. The nozzles 113 are assembled into a box-like structure 161 and the two rows of nozzles are separated from each other by a wall 162 of sheet metal or the like. Such rows are disposed at two levels close to or immediately above each other. As can be seen in FIGS. 5 and 6, the inner end portion of the upper row of nozzles 113 overlaps the inner portion of the lower row of nozzles 113. The overlapping nozzles 113 of the upper row (FIG. 7) have orifices which are inclined with reference to the remaining orifices of the same row in a direction toward that portion of the stream 139 which is to form the stream 43, and the overlapping nozzles 113 of the lower row (FIG. 8) have orifices which are inclined with reference to the remaining orifices of the lower row so as to direct currents of compressed air toward that portion of the stream 139 which is to form the second stream 44. The box-shaped structure 161 is shiftable transversely of the stream 139 (arrow 120A) to thereby change the ratio of tobacco particles in one of the second streams with reference to the ratio of tobacco particles in the other second stream.

The structure 161 with its wall 162, nozzles 113 and source 114 not only constitute a means for dividing the stream 139 into two equal streams but also a means for regulating the quantity of tobacco particles in each of the second streams, i.e., for determining the distribution of particles which form the stream 139 in two smaller streams each of which preferably contains the same mass of tobacco per unit length.

The box-shaped structure 161 is mounted on or adjacent the channel 111.

Figure 10:
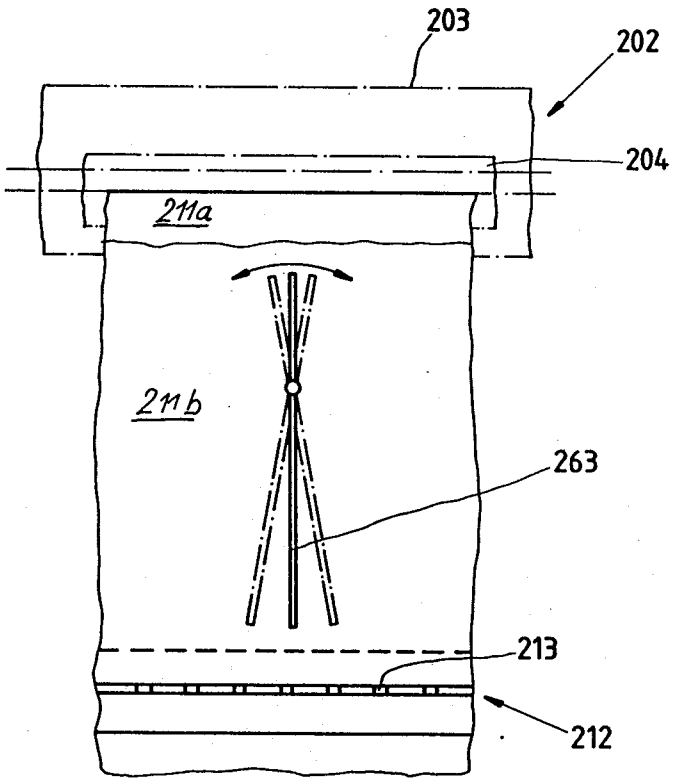
FIG. 10 is a partly elevational and partly vertical sectional view as seen in the direction of arrows from the line X—X of FIG. 9.
Figure 9:
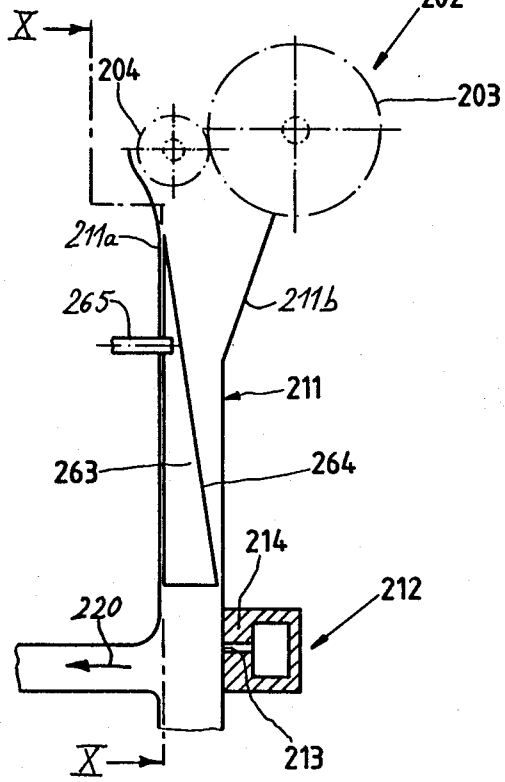
FIG. 9 is a fragmentary schematic vertical sectional view of a third apparatus wherein the distribution of fibrous material across the first stream is regulated in a third way.

FIGS. 9 and 10 show a portion of a third apparatus, and more particularly a modified means for regulating the distribution of tobacco particles across the width of the first stream which is to be divided into several smaller second streams, preferably in a manner as shown in FIG. 1. To this end, the channel 211 contains a regulating element in the form of a pivotable flap 263 whose thickness (as considered transversely of the channel 211 and in the direction of arrow 220 (corresponding to the arrow 20 of FIG. 1) increases gradually from the wider upper end toward the narrower lower end of the channel. The flap 263 is mounted on a pivot member 265 on the wall 211*a* of the channel 211 and its front edge face 264 slopes downwardly in a direction from the wall 211*a* toward the wall 211*b* opposite the wall 211*a*. By pivoting the flap 263 in the one or the other direction from a neutral position which is shown in FIG. 10 by solid lines, one can alter the quantity of tobacco particles which descend from the region where the picker roller 204 opens particles from the carding of the drum 203 at the evacuating station 202 so that the one or the other half of the shower which descends into the range of air currents issuing from the nozzle or nozzles 213 and supplied by the source 214 of the accelerating device 212 will contain a larger or smaller quantity of tobacco. More particularly, the adjustment which is effected by the flap 263 will be relied upon to ensure that the two second streams which are formed by subdividing the stream of particles descending in the channel 211 (and, if desired, the flow of particles furnished by a duct corresponding to the duct 33 of FIG. 1) will contain identical quantities of tobacco particles per unit length. The sloping edge face 264 reduces the likelihood of accumulation of tobacco particles between this edge face and the wall 211*b*.

FIG. 11 shows that the quantity of tobacco particles in the second streams can be regulated by regulating the distribution of tobacco particles in the flow 329*a* which is delivered by the vibratory trough conveyor 331. This conveyor has an oblique edge face 332 over which the particles of the flow 329*a* descend into the duct 33 (not shown in FIG. 11). The regulating means comprises a flap 367 which is installed in the conveyor 331 and is pivotable at 366 to assume any one of a number of different angular positions and to thereby direct more or less tobacco toward the one or the other marginal portion of the conveyor 331 and hence into the one or the other half of the first tobacco stream which is formed beneath the conveyor 331 in a manner as shown at 28 in FIG. 1. Since the surplus which forms the flow 29*a* or 329*a* can constitute up to 30 percent of tobacco in the first stream, a regulation of distribution of such surplus in the conveyor 331 can influence the distribution of tobacco in the first stream beneath the edge face 332 of the conveyor 331 to a considerable extent. The flap 367 can be adjusted by hand upon reading the results of monitoring the density of second streams at the undersides of the foraminous conveyors 56 or the density of fillers which are obtained from the second streams. Alternatively, the adjustment can be carried out automatically in response to signals from the density monitoring devices in a manner well known from the art of making cigarettes and like rod-shaped smokers' products.

The provision of some means (such as the movable partition 41, the movable structure 161, the pivotable flap 263 and/or the pivotable flap 367) for regulating the quantity of tobacco particles in the second streams is desirable and advantageous because this compensates for practically unavoidable fluctuations in the distribution of tobacco particles in the one and/or the other flow. For example, and referring again to FIG. 1, the quantity of particles in the flow 29 will be affected by the percentage of heavier particles 19 in the shower 8 and/or by the percentage of lightweight particles 18*a* which advance beyond the cell wheel 22 but are not caused to rise in the duct 23. Moreover, the distribution of particles in the flow 29 will be influenced by the extent to which the particles 17 and/or 18 and/or 18*a* are interlaced when they reach the stream building zone 28. The distribution of particles in the flow 29*a* or 329*a* will be influenced by the homogeneousness or lack of homogeneousness of second streams 43, 44 which reach the respective conveyors 56 where the surplus is removed by conventional trimming or equalizing devices. The provision of some means for regulating the quantity of tobacco particles in the second streams compensates for such unavoidable fluctuations and ensures that the machine which uses the improved apparatus can turn out two rows or files of identical rod-shaped articles, not only as regards their diameters and lengths but also as concerns the density of tobacco fillers in their wrappers. As described above, a regulation can take place at the diverting station 41 (FIGS. 2–3), at the accelerating station (FIGS. 4–8), in the vibratory conveyor which forms the flow 29*a* or 329*a* (FIG. 11) and/or between the carded drum and the classifying station (FIGS. 9–10).

An advantage of the improved method and apparatus is that the fibrous material is treated gently, that the paths along which the streams are conveyed are relatively short, that the conveyor means for the first and second streams are simple, and that the means for building the first stream can include parts which have been found to be highly satisfactory in existing cigarette makers and like machines which form a single rod of wrapped fibrous material. The likelihood of a pileup of particles at the diverting station is remote and the quantity of particles in each second stream can be regulated in a predictable manner and in a simple and efficient way, either by hand or automatically.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of simultaneously making a plurality of streams of fibrous material, such as tobacco, comprising the steps of building a first stream and conveying the first stream in a predetermined direction along an arcuate first path, said first stream including a first moving carpet of fibrous material which travels in said predetermined direction and has a first width; and dividing the first stream into a plurality of second streams, including diverting fibrous material of the first stream from the first path into a plurality of divergent second paths, each of said second streams including a second carpet which travels along the respective second path and has a second width, the sum of said second widths being equal to or approximating said first width.

2. A method of simultaneously making a plurality of streams of fibrous material, such as tobacco, comprising the steps of building a first stream and conveying the first stream in a predetermined direction along an arcuate first path, said building step including uniting several discrete flows of fibrous material into said first stream; dividing the first stream into a plurality of second streams, including diverting fibrous material of the first stream from the first path into a plurality of divergent second paths; and regulating the quantities of fibrous material in said second paths, including varying the distribution of fibrous material in one of said flows across said first path.

3. The method of claim 3, further comprising the step of converting each second stream into a rod-like filler, including removing fibrous material from the respective second streams, and accumulating the fibrous material which is removed from at least one second stream into said one flow.

4. Apparatus for simultaneously making a plurality of streams of fibrous material, such as tobacco, comprising first conveyor means having a first guide surface defining a first path; means for building a continuous first stream of fibrous material, said first conveyor means further including means for advancing the first stream in a predetermined direction along said first guide surface; and a plurality of second conveyor means each having a second guide surface defining a discrete second path, each of said second paths diverging from said first path downstream of said stream building means, said second conveyor means further comprising means for diverting different portions of the first stream into the respective second paths wherein the diverted portions of the first stream form second streams advancing along the respective second guide surfaces, said diverting means including a source of compressed gaseous fluid and nozzles for directing currents of gaseous fluid from said source against selected portions of the first stream, at least one of said nozzles being adjustable to alter or shift the direction of the respective current of gaseous fluid.

5. Apparatus for simultaneously making a plurality of streams of fibrous material, such as tobacco, comprising first conveyor means having a first guide surface defining a first path; means for building a continuous first stream of fibrous material, said stream building means including first and second feeding units arranged to supply fibrous material to a predetermined portion of said first path and said first conveyor means further including means for advancing the first stream in a predetermined direction along said first guide surface; a plurality of second conveyor means each having a second guide surface defining a discrete second path, each of said second paths diverging from said first path downstream of said stream building means, said second conveyor means further comprising means for diverting different portions of the first stream into the respective second paths wherein the diverted portions of the first stream form second streams advancing along the respective second guide surfaces; and means for regulating the distribution of fibrous material of the first stream among the second streams, including means for varying the distribution of fibrous material from said second feding unit across said predetermined portion of said first path.

6. Apparatus for simultaneously making a plurality of streams of fibrous material, such as tobacco, comprising first conveyor means having a concave first guide surface defining a first path having a first width; means for building a continuous first stream of fibrous material, said first conveyor means further including means for advancing the first stream in a predetermined direction along a first guide surface; and a plurality of second conveyor means each having a concave second guide surface defining a discrete second path having a second width, the sum of said second widths being equal to or approximating said first width and each of said second paths diverging from said first path downstream of said stream building means, said second conveyor means further comprising means for diverting different portions of the first stream into the respective second paths wherein the diverted portions of the first stream form second streams advancing along the respective second guide surfaces.

* * * * *